United States Patent [19]

Eklöf

[11] Patent Number: 4,510,052

[45] Date of Patent: Apr. 9, 1985

[54] OPERATING SYSTEM FOR CENTRIFUGAL SEPARATORS

[75] Inventor: Ulf Eklöf, Södertälje, Sweden

[73] Assignee: Alfa-Laval Separation AB, Tumba, Sweden

[21] Appl. No.: 576,549

[22] Filed: Feb. 3, 1984

[51] Int. Cl.[3] ..... B04B 11/00

[52] U.S. Cl. ..... 210/139; 210/371; 494/11; 494/27

[58] Field of Search ..... 210/138, 360.1, 369, 210/371, 139; 494/2, 11, 27, 56

[56] References Cited

U.S. PATENT DOCUMENTS

| | | | |
|---|---|---|---|
| 2,828,020 | 3/1958 | Huser et al. | 210/371 X |
| 3,642,196 | 2/1972 | Nilsson | 210/371 X |
| 3,938,734 | 2/1976 | Wilke | 494/11 |

FOREIGN PATENT DOCUMENTS

| | | | |
|---|---|---|---|
| 1097430 | 1/1968 | United Kingdom | 210/369 |

*Primary Examiner*—Richard V. Fisher
*Assistant Examiner*—W. Gary Jones
*Attorney, Agent, or Firm*—Cyrus S. Hapgood

[57] ABSTRACT

In an operating system for a centrifuge rotor having valve means being operable by means of so called operating liquid for opening and closing peripheral outlets in the rotor, an injector device for supplying operating liquid to the rotor is used which comprises a chamber divided by a movable wall into an air side and a liquid side. The liquid side of the injector device is maintained in hydraulic contact with an injection inlet to the centrifuge rotor before an opening procedure is to be started, which is effected by opening a time controlled air valve on the air side of the injector device. The air valve is further connected to a compressed air source through a buffer vessel so that a controlled air pressure is used for the injection of operating liquid to the rotor.

6 Claims, 2 Drawing Figures

OPERATING SYSTEM FOR CENTRIFUGAL SEPARATORS

Figure 1:
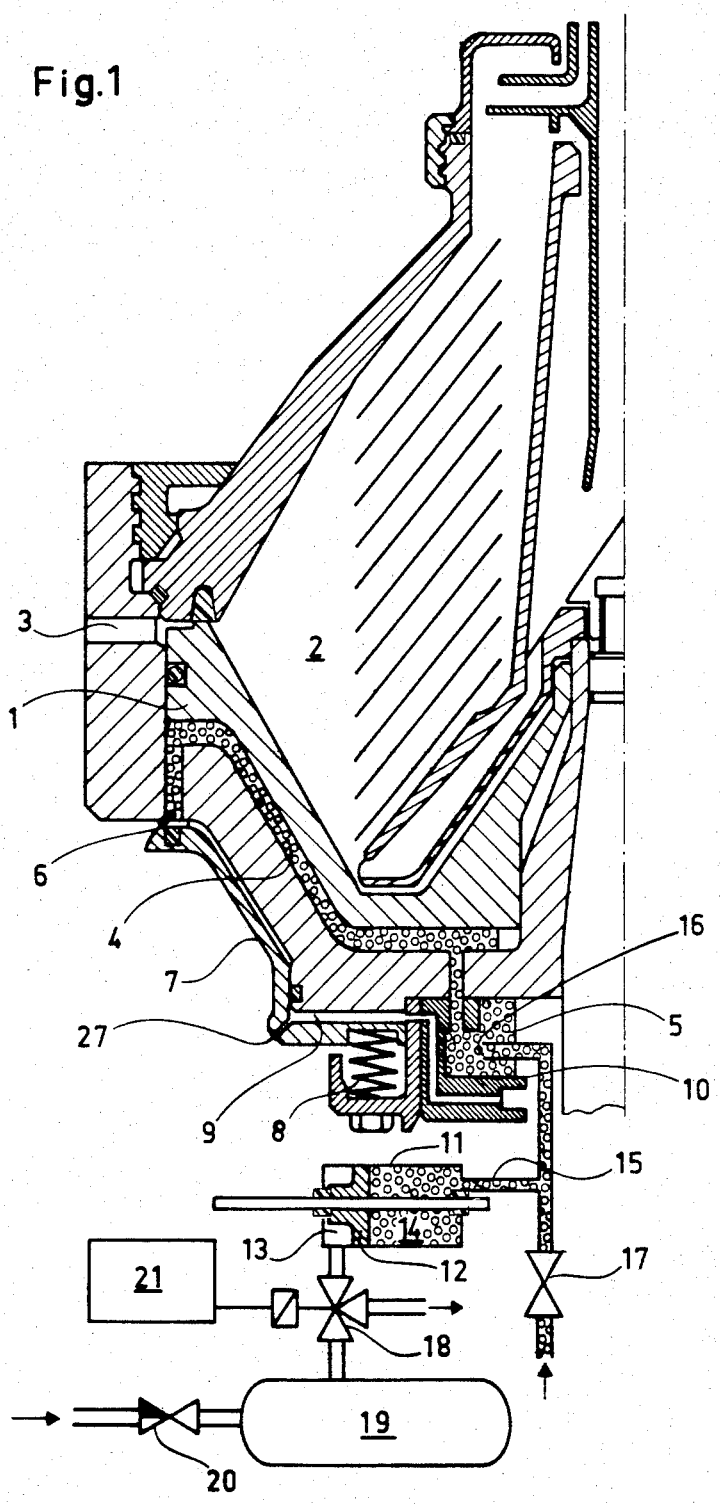

The present invention relates to a device for supplying so called operating liquid to a centrifuge rotor during operation to initiate an opening-closing procedure for discharging heavy phase from the rotor through peripheral outlets in the same, the rotor having valve means for controlling either directly said outlets or indirectly by draining so called closing liquid trapped under a slide member, which cooperates with said outlets, said valve means being operable to open in presence of a certain amount of operating liquid in a so called opening chamber being connected to a receiving chamber in the central part of the rotor for receiving operating liquid from a static outlet of an injector device located outside the rotor.

To achieve an opening-closing procedure for discharging heavy phase through peripheral sludge outlets in a centrifugal separator during operation, several different operating systems are known which are based on the principle of supplying operating liquid during a short period of time from outside to an opening chamber cooperating with valve means, which either directly controls said sludge outlets or indirectly controls the same by draining operating liquid from a closing chamber located on one side of a slide member, which cooperates with said sludge outlets. A main problem in designing these operating systems have been to achieve a sufficiently rapid opening-closing procedure. The higher is the velocity of supplying operating liquid to the opening chamber, the larger out-flow area for the sludge is achieved, which reduces the risk of failure in discharging sludge having a tendency to adhere on the rotor walls.

A further problem has been to achieve sufficient reliability and reproduction accuracy in the sludge-liquid volume passing through the sludge outlets at each opening-closing procedure. For the purpose of achieving rapid and reproducible opening-closing procedure, there has on one hand been achieved several designs of the part of the operating system located within the centrifuge rotor, and on the other hand efforts have been made to improve the part of the operating system located outside the rotor for supplying or dosing operating liquid. Irrespective of the operating system design associated with the rotor, the design of the part of the operating liquid system outside the rotor is decisive for the control and reproducibility of the opening-closing procedure is largely all existing separators of the kind introductively mentioned. The present invention relates to an improvement of the part of the operating liquid system located outside the rotor, which improvement can be generally utilized in practically all existing types of operating liquid systems in separators of the kind concerned.

In most existing operating systems operating liquid is introduced into a receiving chamber in the centrifuge rotor by opening of valves in one or several liquid lines connecting a liquid injection inlet to the rotor with a liquid source of a certain pressure. The control of the opening-closing procedure is achieved through the selection of liquid pressure and time control of said valves. These systems have several disadvantages. Limited available liquid pressure and pressure drop in lines and valves put an upper limit to the liquid flow that can be injected into the rotor. Further, the reproducibility with respect to the injection velocity as well as the total amount of injected liquid is not satisfactory. The injection velocity changes with pressure fluctuations of the available liquid source, which often consists of an existing tap water line. The accuracy in the amount of injected liquid is impaired by the uncertainty in the amount of water which possibly remains in the supply line between the closing valve and the injection inlet to the rotor and also by the inertness of the closing valve which makes the time control more inexact the more rapid injection and sorter injection time that is selected.

To increase the injection velocity of operating liquid to the centrifuge rotor and to achieve a better control of the injected amount of liquid it has also been suggested air pressure controlled dosing devices comprising an injector housing in which a desired volume of operating liquid can be trapped and pressed into the rotor by means of compressed air acting on a movable wall in the injector housing. Even if thereby a better control of injected amount of liquid is achieved, there still remains the uncertainty with respect to the amount of liquid due to the possibly remaining liquid between the closing valve in the liquid supply line and the injection opening to the centrifuge rotor. The greatest disadvantage of this system is, however, that complete reproducibility in the system can never be achieved by mere volume dosing. As mentioned above, the injection velocity influences, especially in the initial part of an opening procedure, on the opening size of the sludge outlets and thereby on the amount of sludge-liquid streaming out through the sludge outlets.

The object of the present invention is to achieve an operating system for a centrifugal separator of the kind introductively mentioned, which operating system makes possible safe control and high reproducibility in supplying operating liquid to the centrifuge rotor both with respect to injected amount of liquid and to injection velocity.

This object has been reached according to the invention by means of an operating system comprising an outside the rotor located air pressure controlled injector device having an injector housing which is divided in an operating liquid side and a compressed air side by a movable wall, the operating liquid side of the injector housing being connected with a static outlet to a receiving chamber formed in the central part of the rotor and also being connected to a liquid source of sufficient pressure to provide hydraulic contact between said static outlet and said operating liquid side and also being connectable to a liquid source for refilling the injector housing and returning said movable wall to an end position before a new opening-closing procedure, said compressed air side being provided with a valve for venting air as the movable wall is returned, the system further comprising a pressure vessel provided with means for connection to a compressed air source and for adjusting the desired air pressure in the pressure vessel, said pressure vessel being connected with said compressed air side through a time controlled air valve for, at opening of the same, instantaneously transmitting the air pressure adjusted in the pressure vessel to hydraulic pressure in the operating liquid right out to said static outlet and instantaneously achieving injection of operating liquid into said receiving chamber in the rotor with an injection velocity being dependent on the air pressure adjusted in said pressure vessel.

According to the invention, hydraulic contact between the liquid in the injector housing and the injector outlet to the centrifuge can be maintained by eliminating the valve used in prior systems in the line which connects the injector device with the rotor and instead actuating a valve on the air side of the injector housing to start an opening procedure. Further, the control of the injection time is improved considerably in that the air valve is less inert in operation compared with a liquid valve on the liquid side of the injector housing in prior systems.

Finally, a very important contribution to the improved control of the injection velocity resides in the connection of a buffer vessel between the compressed air source and the air valve, whereby the instantaneous heavy pressure drop otherwise occurring at the start of an injection procedure is eliminated. Such a pressure drop, which is often not constant or reproducible, increases considerably the unreliability of a time controlled dosing system.

The operating system according to the invention makes possible injection of a reproducible amount of operating liquid through time control so that the need for volume dosing is eliminated. This does not mean, however, that volume dosing should be incompatible with the idea of the invention. If the injector housing is provided with adjusting means for volume dosing, it is foreseen within the scope of the invention the possibility of indirect time control. The injection time is then controlled by adjustment of a certain pressure in the pressure vessel so that a certain selected pressure corresponds to a certain injection velocity and thereby a certain period of time that is required for injecting the volume of operating liquid enclosed in the injector housing. In other words, it it achieved through the invention that the injection velocity can now be controlled so that time control of the injection procedure no longer causes any problems but constitutes a preferred control method, since controlling the air valve by standard time control components is more convenient than adjusting mechanically means in the injector housing.

Figure 2:
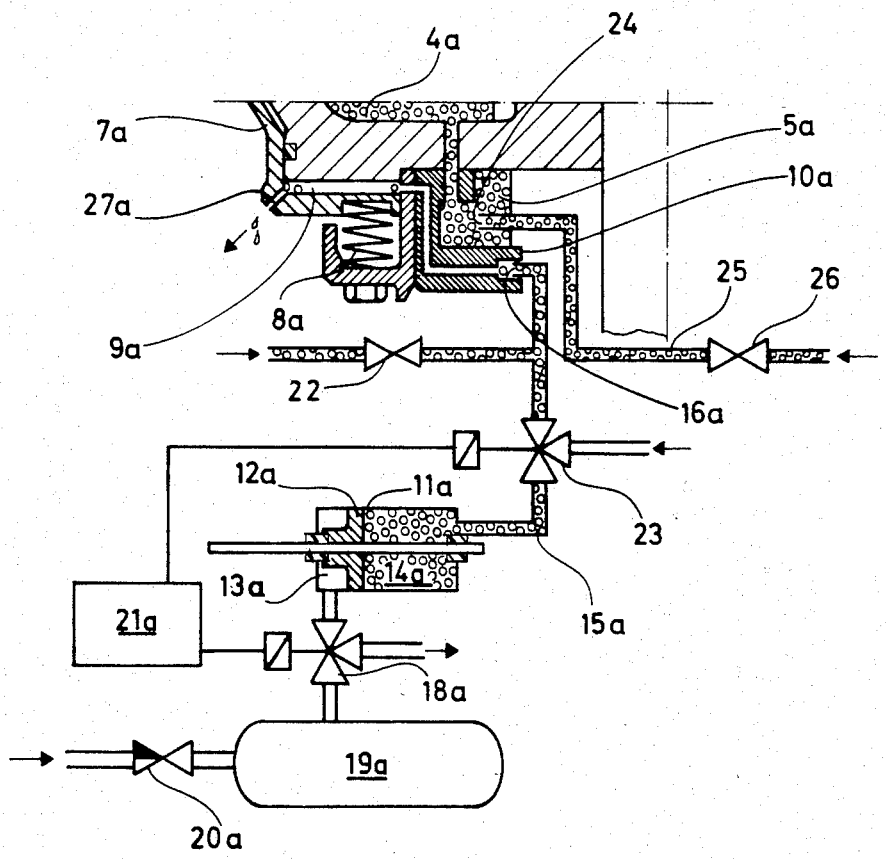

The invention is described in more detail in the following, with reference to the accompanying drawings, in which FIG. 1 schematically shows an embodiment of the operating system according to the invention and its connection to a centrifugal separator with a piston slide member for intermittently opening and closing of peripheral sludge outlet, and FIG. 2 shows an alternative embodiment of the operating system according to the invention for the separator shown in FIG. 1.

The centrifuge rotor as illustrated is provided with a piston slide member 1 forming the lower partition wall of a separation chamber 2. The separation chamber 2 has peripheral outlets 3, which can be opened and closed during operation by axial movement of the piston slide member 1. Below the piston slide member 1 a so called closing chamber 4 is formed, in which operating liquid exerts an upwards directed hydraulic pressure on the slide member 1. For supply of operating liquid the closing chamber 4 is connected with an annular liquid receiving chamber 5 in the centre part of the rotor, and for draining of operating liquid the closing chamber is provided with peripheral outlets 6, which are opened and closed by axial movement of a slide member 7.

The slide member 7 is maintained by means of spring means 8 in an upper position, at which the outlets 6 are closed, and is movable downwards so that the outlets 6 are opened when such an amount of operating liquid is introduced into an opening chamber 9 formed on the upper side of the slide member 7 so that the hydraulic pressure formed by the centrifugal force exceeds the spring force of the spring means 8. Operating liquid is supplied to the opening chamber 9 through a central rotor inlet 10, which simultaneously forms overflow from the receiving chamber 5. The opening chamber 9 is further provided in its peripheral part with constantly open nozzles 27 for draining of operating liquid.

The static part of the operating system located outside the centrifuge rotor comprises an injector housing 11, in which a compressed air side 13 and an operating liquid side 14 is defined on the opposite sides of a piston member 12. The operating liquid side 14 is in hydraulic contact with a static outlet 16 to the rotor through a line 15. The outlet 16 is positioned within the receiving chamber 5 to form an operating liquid level, which is maintained in that the line 15 is also connected to a liquid pressure source through a nonreturn valve 17. This liquid pressure source can for example be constituted by a level vessel mounted on a certain height above the static outlet 16.

The compressed air side 13 of the injector housing is connected through a three-way valve 18 to a pressure vessel 19 which is connected to a compressed air source through a pressure control valve 20. The three-way valve 18 is further connected to a time control device 21 for opening the connection between the pressure vessel 19 and the compressed air side 13 of the injector housing when an opening procedure is to be started and for closing said connection after a pre-set period of time and simultaneously connecting the compressed air side 13 to the atmosphere for venting air from the injector housing as the piston member 12 is returned to its stop position for a new opening-closing procedure by means of the pressure from the liquid pressure source connected to line 15.

The system is operated as follows: Before a separation run the desired period of time when the valve 18 is open for connection between the pressure vessel 19 and the compressed air side 13 of the injector housing is programmed into the control device 21. Further the desired pressure in the pressure vessel 19 is adjusted. The volume of the content in the separation chamber to be discharged through the peripheral outlet 3 at an opening-closing procedure is determined by the amount of operating liquid injected into the receiving chamber 5 and also by the injection velocity of the operating liquid. When time control is used, the amount of operating liquid is dependent on both the injection time and the pre-set air pressure, while the injection velocity is determined by the air pressure exerted on the compressed air side 13. Since the line 15 is completely open and always filled with liquid right up to the static outlet 16 and since the air pressure on the compressed air side 13 and the opening time of the air valve 18 can be controlled with good accuracy, it is realized that an opening-closing procedure of extremely good reproducibility can be achieved.

The embodiment shown in FIG. 2 is principally different from the one of FIG. 1 in that the system is designed for direct supply of operating liquid to the opening chamber **9*a* from the static outlet 16*a* of the operating liquid side 14*a* of the injector housing. Since largely the same static equipment as shown in FIG. 1 can be used also in this case, components being identical with those of FIG. 1 have been given the same reference figure with the addition of the letter a. To maintain hydraulic contact between the operating liquid side 14***a* of the injector housing and the static outlet 16*a* into the opening chamber 9*a*, the line 15*a* is connected to a liquid source through a valve 22 for supplying to the opening chamber a small liquid flow, which is not sufficient for initiating an opening procedure. This small liquid flow is thus drained through the constantly open nozzle 27*a* at the periphery of the opening chamber 9*a* so that the hydraulic pressure in the opening chamber 9*a* required for pressing down the slide member 7*a* is not reached.

For returning the piston member 12*a* after an opening-closing procedure the liquid flow through the throttle valve 22 is possibly insufficient. Therefore the line 15*a* is also provided with a valve means 23, which after an opening-closing procedure can be operated to close the connection between the operating liquid side 14*a* and the static outlet 16*a* and to connect the operating liquid side to a liquid pressure source, which for example can be the same liquid source which is connected to the valve 22. The valve means 23, in this case being a three-way valve, is connected to the control device 21*a* to be actuated between its two operative positions in a suitable phase of time between two successive opening-closing procedures. The presence of the valve means 23 and its manoeuvring in line 15*a* has no influence whatsoever on the accuracy and the reproducibility of the operating system, since the valve will be completely open and hydraulic contact between the operating liquid side 14*a* and the static outlet 16*a* will be reestablished before a successive opening procedure is to be started.

The closing chamber 4*a* is in this case connected to a separate receiving chamber 24, which is supplied with closing liquid through a line 25 and a valve 26 from suitable liquid source. To make the closing procedure independent of the liquid flow supplied through line 25, the receiving chamber 24 can be dimensioned so that it contains about the same amount of liquid as the closing chamber 4*a*. The supply of closing liquid to the closing chamber 4*a* is then controlled by the area of the connection passages between the receiving chamber 24 and the closing chamber. The rate of supplying closing liquid to the closing chamber must of course be of an order well below the draining capacity of the draining valves in the periphery of the closing chamber in order not to considerably reduce the rapid opening procedure made possible by means of the operating system according to the invention.

I claim:

1. In combination with a centrifuge rotor having means defining a separating chamber and means defining peripheral outlets for discharging a separated heavy phase from said chamber, the rotor also having means defining an opening chamber and valve means operable to open said outlets in response to the presence of a certain amount of operating liquid in said opening chamber, the rotor also having means defining a central receiving chamber communicating with said opening chamber to provide it with a controlled supply of said liquid for operating said valve means to open and close the peripheral outlets, an injector device having a static outlet for supplying the operating liquid to said receiving chamber, said device being located outside the rotor and comprising a housing, a movable wall in the housing defining an operating liquid side and a compressed air side of the housing, said operating liquid side being connected with said static outlet, liquid source means connected to said operating liquid side and of sufficient pressure to provide hydraulic contact between said static outlet and said operating liquid side, said source means being operable to refill the injector housing and return said movable wall to an end position in preparation for a new opening and closing of said peripheral outlets, a venting valve associated with said compressed air side for venting air therefrom as the movable wall is returned to said end position, a pressure vessel, means for connecting said vessel to a compressed air source and for adjusting the air pressure in the vessel, and a time-controlled air valve through which said pressure vessel is connected with said compressed air side, the injector device being operable upon opening of said air valve to instantaneously transmit the air pressure in said vessel to hydraulic pressure in a body of the operating liquid extending continuously from said movable wall to said static outlet, and to instantaneously inject operating liquid into said receiving chamber at an injection velocity dependent upon the adjusted air pressure in said vessel.

2. The combination of claim 1, in which said opening chamber is connected to said receiving chamber through an overflow from the receiving chamber, said static outlet being located within the receiving chamber to form a liquid level which is maintained by overpressure from said liquid source means, the combination comprising also a non-return valve connecting said liquid source means to said operating liquid side of the injector housing.

3. The combination of claim 1, in which said receiving chamber communicates directly with said opening chamber, the combination comprising also a throttle connecting said liquid source means to said operating liquid side of the injector housing, said throttle being operable to maintain a small liquid flow from the static outlet into the opening chamber, said liquid flow being insufficient to initiate opening of said peripheral outlets.

4. The combination of claim 3, comprising also further valve means between said operating liquid side and said static outlet, said further valve means being operable to close the connection between said operating liquid side and said static outlet, to connect said operating liquid side to said liquid source means for returning said movable wall to said end position, to reclose the connection with said liquid source means, and to reestablish the connection between said operating liquid side and said static outlet.

5. The combination of claim 1, in which said venting valve and said air valve are included in a three-way valve which, in a first position, connects said compressed air side with atmosphere and, in a second position, connects said pressure vessel with said compressed air side.

6. The combination of claim 1, in which said movable wall is a piston.

* * * * *